US011300264B2

(12) United States Patent
Shyu

(10) Patent No.: US 11,300,264 B2
(45) Date of Patent: Apr. 12, 2022

(54) VEHICLE LIGHTING SYSTEM

(71) Applicant: Young Optics Inc., Hsinchu Science Park (TW)

(72) Inventor: Jyh-Horng Shyu, Hsinchu Science Park (TW)

(73) Assignee: YOUNG OPTICS INC., Hsinchu Science Park (TW)

( * ) Notice: Subject to any disclaimer, the term of this patent is extended or adjusted under 35 U.S.C. 154(b) by 326 days.

(21) Appl. No.: 16/601,424

(22) Filed: Oct. 14, 2019

(65) Prior Publication Data

US 2020/0041084 A1 Feb. 6, 2020

Related U.S. Application Data

(62) Division of application No. 14/664,485, filed on Mar. 20, 2015, now Pat. No. 10,443,799.

(30) Foreign Application Priority Data

Aug. 6, 2014 (TW) ..... 103126845

(51) Int. Cl.
*F21S 41/143* (2018.01)
*F21S 41/20* (2018.01)
*F21S 41/675* (2018.01)
*F21S 41/16* (2018.01)

(52) U.S. Cl.
CPC ..... *F21S 41/143* (2018.01); *F21S 41/16* (2018.01); *F21S 41/285* (2018.01); *F21S 41/675* (2018.01)

(58) Field of Classification Search
CPC .... F21S 48/1145; F21S 48/1154; F21S 48/12; F21S 48/1225; F21S 48/125; F21S 48/17; F21S 48/1721; F21S 48/1726; F21S 48/1752; F21S 48/15757; F21S 48/1763; F21S 48/1768
USPC ..... 362/464–466, 520–521, 538
See application file for complete search history.

(56) References Cited

U.S. PATENT DOCUMENTS 5,777,789 A * 7/1998 Chiu ..... H04N 9/3105 359/487.04
6,431,731 B1 * 8/2002 Krietzman ..... H01S 3/005 359/28
6,575,610 B2 * 6/2003 Natsume ..... F21S 43/26 362/520
6,969,183 B2 * 11/2005 Okubo ..... B60Q 1/085 362/466

(Continued)

*Primary Examiner* — Jason M Han
(74) *Attorney, Agent, or Firm* — Muncy, Geissler, Olds & Lowe, P.C.

(57) ABSTRACT

A vehicle lighting system includes a light processing unit, a non-uniform projection unit, a sensing unit, a judgment unit, and an operation unit. The light processing unit is capable of changing an intensity profile of a light beam, and the judgment unit receives an image signal from the sensing unit to determine whether to change the intensity profile of the light beam according to the image signal. When the intensity profile needs to be changed in accordance with the judgment result, the operation unit calculates out a desired intensity profile and outputs a control signal containing information about the desired intensity profile to the light processing unit, and the light processing unit changes the intensity profile of the light beam according to the control signal and sends out the light beam with the desired intensity profile.

18 Claims, 2 Drawing Sheets

(56) References Cited

U.S. PATENT DOCUMENTS

| | | | | |
|---|---|---|---|---|
| 8,070,339 | B2 * | 12/2011 | Koike | F21S 41/275<br>362/538 |
| 9,435,503 | B2 * | 9/2016 | Masuda | B60Q 1/0023 |
| 2006/0018025 | A1 * | 1/2006 | Sharon | H04N 9/3129<br>359/618 |
| 2007/0025204 | A1 * | 2/2007 | Mori | G02B 5/32<br>369/44.23 |

* cited by examiner

VEHICLE LIGHTING SYSTEM

CROSS REFERENCE TO RELATED APPLICATIONS

This application is a divisional application of U.S. application Ser. No. 14/664,485, filed Mar. 20, 2015, for which priority is claimed under 35 U.S.C. § 120, the entire contents of which are hereby incorporated by reference.

BACKGROUND OF THE INVENTION a. Field of the Invention

This relates generally to an illumination system, and more particularly, to a lighting system for vehicles.

b. Description of the Related Art

To ensure road safety, design parameters for a vehicle headlamp, such as irradiance and luminous intensity distribution, should conform to specific headlamp standards. Besides, basic requirements such as energy saving and high luminous efficiency should be also met on constructing a headlamp.

Typically, light beams emitted from a light source, such as a halogen lamp, a metal-halide lamp or an LED, are not ready for use unless they are shaped to have a specific intensity profile intended for use in vehicle illumination. However, this may result in certain loss of luminous intensity. Further, conventional vehicle headlamps often provide a non-adjustable intensity profile and luminous intensity, where most of light are directed towards the front of a vehicle to reduce the luminous intensity of surrounding areas. Therefore, when pedestrians or animals quickly move from surrounding areas having low luminous intensity to the front of a vehicle, a driver may fail to timely deal with such emergency to cause an automobile accident. Therefore, it is important to provide a vehicle lighting system capable of dynamically controlling the irradiance and luminous intensity distribution in response to surrounding conditions to ensure safe driving.

BRIEF SUMMARY OF THE INVENTION

An aspect of the invention concerns a vehicle lighting system having improved luminous efficiency.

Another aspect of the invention concerns a vehicle lighting system capable of dynamically controlling the luminous intensity distribution and irradiance in response to surrounding conditions to ensure safe driving.

According to an embodiment of the invention, a vehicle lighting system includes a light source, a beam expander, a light processing unit, and a non-uniform projection unit. The light source emits at least one collimated light beam, and the beam expander is located in a propagation path of the collimated light beam for receiving and expanding the collimated light beam to form an expanded light beam. The light processing unit is located in a propagation path of the expanded light beam for receiving the expanded light beam and a control signal and adjust an intensity profile of the expanded light beam according to the control signal, and the non-uniform projection unit converts the expanded light beam adjusted by the processor into a light beam having a non-uniform intensity profile.

According to another embodiment of the invention, a vehicle lighting system includes a light processing unit, a non-uniform projection unit, a sensing unit, a judgment unit, and an operation unit. The light processing unit is capable of changing an intensity profile of a light beam, and the non-uniform projection unit is capable of converting the light beam processed by the light processing unit into a light beam having a non-uniform intensity profile. The sensing unit detects surrounding conditions and outputs at least one image signal in response to the detected surrounding conditions. The judgment unit receives the image signal from the sensing unit to determine whether to change the intensity profile of the light beam according to the image signal, and the operation unit receives a judgment result of the judgment unit. When the intensity profile needs to be changed in accordance with the judgment result, the operation unit calculates out a desired intensity profile and outputs a control signal containing information about the desired intensity profile to the light processing unit, and the light processing unit changes the intensity profile of the light beam according to the control signal and sends out the light beam with the desired intensity profile.

According to another embodiment of the invention, a method for fabricating a vehicle lighting system includes the following steps: providing a beam expander for expanding a collimated light beam to form an expanded light beam; providing a light processing unit for receiving the expanded light beam and adjusting an intensity profile of the expanded light beam according to a control signal; and providing a non-uniform projection unit for converting the intensity profile of the expanded light beam into a non-uniform intensity profile. The control signal is in response to surrounding conditions detected at different time points.

According to the above embodiments, an expected non-uniform intensity profile for a vehicle lighting system is obtained by using the non-uniform projection unit, without the need of using other optics to cause a secondary change in the luminous intensity distribution. This may reduce the loss of optical energy. Besides, the digital light processing unit may cooperate with the sensing unit, the judgment unit and the operation unit to control the light-emitting angle, irradiance and luminous intensity distribution of a light-source to cast more light onto a surrounding area where pedestrians or other dynamic objects exist to improve road safety.

Other objectives, features and advantages of the invention will be further understood from the further technological features disclosed by the embodiments of the invention wherein there are shown and described preferred embodiments of this invention, simply by way of illustration of modes best suited to carry out the invention.

DETAILED DESCRIPTION OF THE INVENTION

In the following description of preferred embodiments, reference is made to the accompanying drawings in which it is shown by way of illustration specific embodiments in which the invention can be practiced. It is to be understood that other embodiments can be used and structural changes can be made without departing from the scope of the embodiments of this invention.

Figure 1:
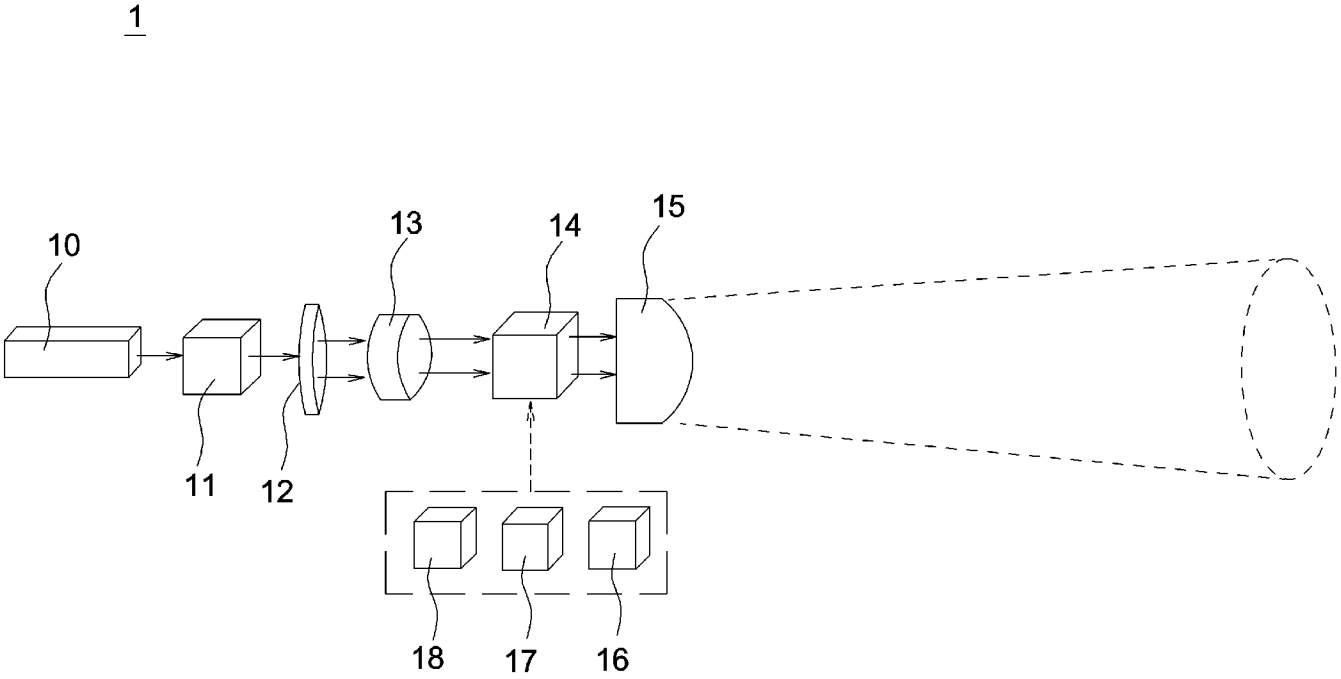
FIG. 1 shows a schematic diagram of a vehicle lighting system according to an embodiment of the invention.

FIG. 1 shows a schematic diagram of a vehicle lighting system 1 according to an embodiment of the invention. The vehicle lighting system 1 includes a light source 10, a beam expander 11, a beam homogenizer 12, a beam shaper 13, a light processing unit 14, a non-uniform projection unit 15, a sensing unit 16, a judgment unit 17 and an operation unit 18.

The light source 10 provides at least one collimated light beam and has a half-angle of light emission of smaller than 30 degrees, preferably being smaller than 15 degrees. The light source 10 with a spot size S1 may be a laser light source, a light-emitting diode (LED), a quantum-dot-based light-emitting diode (QD-LED), or a resonant-cavity light-emitting diode (RC-LED). A light-emitting diode emits light when activated, where electrons are able to recombine with electron holes to release energy in the form of photons. In a quantum-dot-based light-emitting diode, an applied electric field causes electrons and holes to move into a quantum dot layer, where they are captured in the quantum dot and recombine to emit photons. A resonant-cavity light-emitting diode may be formed by arranging a metal top reflector and a bottom distributed Bragg reflector (DBR) in a typical light-emitting diode to confine light in an optical cavity, where light is reflected multiple times to produce standing waves for certain resonance frequencies. In this embodiment, the light source 10 may be a laser light source.

The beam expander 11 is located in a propagation path of the collimated light beam from the light source 10 to receive and expand the collimated light beam, with the spot size S1 being increase to a larger spot size S2. The beam expander 11 may be a lens module capable of expanding incoming light beams. For example, the lens module may include two confocal convex lenses having the same focus or image point to expand incoming light beams, where the magnification of the lens module is obtained by dividing a focus of the rear lens by a focus of the front lens. Alternatively, the lens module may include a concave lens and a convex lens sharing the same focus or image point to expand incoming light beams. In this embodiment, the beam expander 11 may be a laser beam expander comprised of lenses.

The beam homogenizer 12 is located in a propagation path of the collimated light beam transmitted from the beam expander 11 to homogenize the expanded light beam and blur speckles. The beam homogenizer 12 may be a diffuser, a vibrating mirror, a spatial light modulator, or a micro-lens array. The diffuser where diffusion particles are dispersed in a base film scatters incoming light beams. The vibrating mirror destroys the beam coherence through vibration to reduce speckles. The spatial light modulator may alter the polarization state of a light beam by liquid crystal or plasma to reduce speckles. In this embodiment, the beam homogenizer 12 may be a diffuser.

The beam shaper 13 is located in a propagation path of the collimated light beam to modify the shape of the expanded light beam to match the shape of the light processing unit 14. The beam shaper 13 may include a diffraction grating or a reflective mirror to divide an incoming light beam into multiple sub-beams, and the sub-beams are superimposed to form a desired beam shape.

The light processing unit 14 is located in a propagation path of the collimated light beam to receive the shaped light beam and at least one control signal of the operation unit 18, and a luminous intensity distribution of the light processing unit 14 is adjusted according to the control signal. The light processing unit 14 may include digitalized optical switches or light valves (such as DMD, LCD or LCOS) using the digital light processing (DLP) technology. Digital light processing is a type of MEMS technology that often uses a digital micro mirror device (DMD) to receive digital video information and output digitized optical pulses. The digital micro mirror device may include a huge amount of tiny digitalized optical switches (such as micro-mirrors) capable of quickly rotating to dynamically adjust light deflection angles and output brightness. For example, when only half of micro-mirrors of a digital micro mirror device are turned on, the brightness is reduced by half. Similarly, when a digital micro mirror device is turned on and continues for only 0.5 millisecond within each one millisecond, the brightness is also reduced by half. In this embodiment, the light processing unit 14 may be a digital mirror device.

The non-uniform projection unit 15 is located in a propagation path of the collimated light beam and may be a singlet lens, a lens module or an optics assembly (such as a combination of a prism, a mirror or a lens). The non-uniform projection unit 15 receives the light beam processed by the light processing unit 14 to change its intensity profile. The non-uniform projection unit 15 may convert a Gaussian intensity profile to a specific non-uniform intensity profile. In this embodiment, the non-uniform projection unit 15 may be a vehicle lamp cover comprised of at least one lens.

Figure 2:
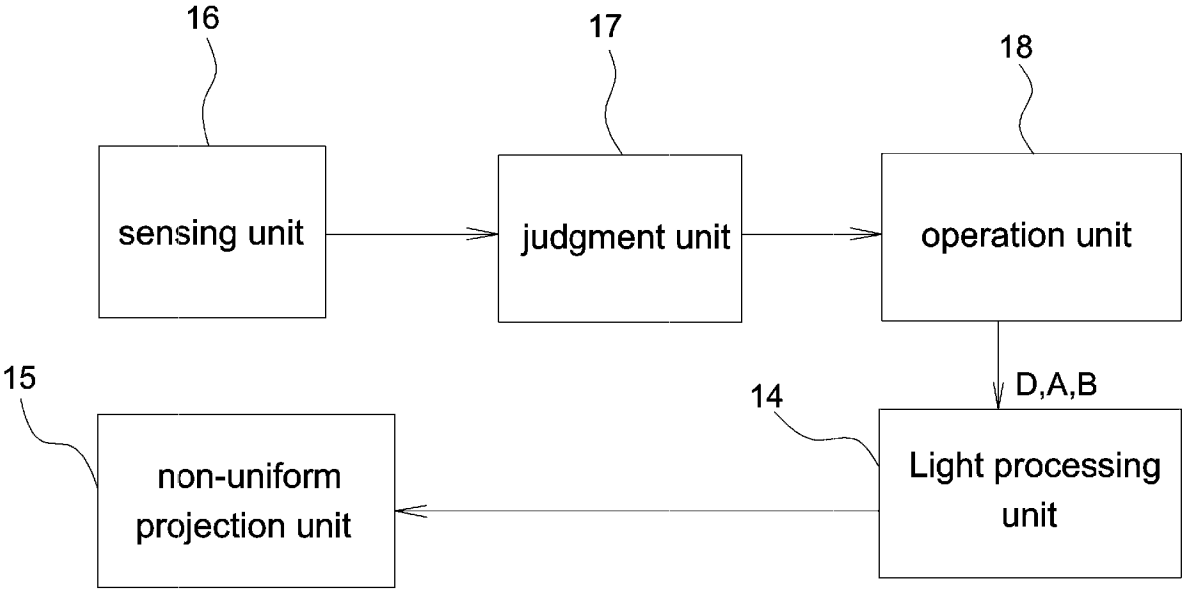
FIG. 2 shows a functional block diagram of a vehicle lighting system according to an embodiment of the invention.

As shown in FIG. 2, the sensing unit 16 may detect surrounding conditions such as position changes of surrounding objects by, for example, infrared radiation, laser beams, millimeter waves, microwaves, ultrasonic sound waves, visible light or thermal imaging and convert detected variations into electrical signals such as image signals. The judgment unit 17 is electrically connected to the sensing unit 16 to receive at least one image signal from the sensing unit 16 to recognize pedestrians or other dynamic objects. In one embodiment, pedestrians or other dynamic objects are recognized by comparing different images in consecutive image frames to find out position changes of an object. In this embodiment, the sensing unit 16 may be a thermal image-sensing module, such as a thermal image camera capable of sensing ambient energy to generate an image signal.

The judgment unit 17 transmits recognized information to the operation unit 18 to analyze the information. The operation unit 18 may calculate out a distance D, an angle A and a luminous intensity distribution B of pedestrians or other dynamic objects relative to the vehicle lighting system 1. The operation unit 18 may, if necessary, compare the information transmitted from the judgment unit 17 with a predetermined luminous intensity distribution of the light source 10 to find out an area needed to be reinforced in luminous intensity. In case pedestrians or other dynamic objects exist in an area having insufficient luminous intensity, control signals including information of the distance D, angle A and luminous intensity distribution B regarding the area are transmitted to the light processing unit 14. The light processing unit 14 receives the control signals from the judgment unit 17 and changes its intensity profile according to the control signals. Finally, the non-uniform projection unit 15 changes the current intensity profile to form a specific non-uniform intensity profile to increase the luminous intensity of the area where pedestrians or other dynamic objects exist.

The sensing unit 16 continually transmits image signals converted from pictures of surrounding areas, and the judgment unit 17 and the operation unit 18 correspondingly output operation results that are updated according to latest pick-up images and provided for the light processing unit 14. As a result, the luminous intensity distribution of the vehicle lighting system 1 can be dynamically adjusted according to the position changes of pedestrians or other dynamic objects. Besides, in case pedestrians or other dynamic objects are not found by the judgment unit 17, the operation unit 18 may output a recovery signal to the light processing unit 14 to allow the vehicle lighting system 1 to recover its initial luminous intensity distribution, with the expanded light beam being returned to an initial non-adjusted intensity profile.

According to the above embodiments, an expected non-uniform intensity profile for a vehicle lighting system is obtained by using the non-uniform projection unit, without the need of using other optics to cause a secondary change in the luminous intensity distribution. This may reduce the loss of optical energy. Besides, the digital light processing unit may cooperate with the sensing unit, the judgment unit and the operation unit to control the light-emitting angle, irradiance and luminous intensity distribution of a vehicle lighting system to cast more light onto a surrounding area where pedestrians or other dynamic objects exist to improve road safety.

Although embodiments have been fully described with reference to the accompanying drawings, it is to be noted that various changes and modifications will become apparent to those skilled in the art. For example, the beam expander 11 and the beam shaper 13 may be integrally formed as one piece. Further, the non-uniform projection unit 15 may be in the form of a singlet lens, a lens module or a vehicle lamp cover. Alternatively, modifications regarding changes in relative positions of different optics should be also made. For example, the beam homogenizer 12 may be disposed in a rear side of the beam shaper 13 to homogenize light beams having been shaped by the beam shaper 13. Further, additional element may be added in the above embodiments. For example, another beam homogenizer may be disposed in a front side of the beam expander 11 to homogenize light beams before the light beams passing through the beam expander 11. Moreover, modifications regarding changes in a propagation path of a collimated light beam in the vehicle lighting system should be also made. Such changes and modifications are to be understood as being included within the scope of the various embodiments as defined by the appended claims.

What is claimed is:

1. A vehicle lighting system, comprising:

a light processing unit capable of changing an intensity profile of a light beam;

a non-uniform projection unit capable of converting the light beam processed by the light processing unit into a light beam having a non-uniform intensity profile;

a sensing unit for detecting surrounding conditions and outputting at least one image signal in response to the detected surrounding conditions;

a judgment unit for receiving the image signal from the sensing unit to determine whether to change the intensity profile of the light beam according to the image signal; and an operation unit for receiving a judgment result of the judgment unit, wherein, the operation unit is configured to calculate out a desired intensity profile and output a control signal containing information about the desired intensity profile to the light processing unit when the intensity profile needs to be changed in accordance with the judgment result, and the light processing unit is configured to change the intensity profile of the light beam according to the control signal and send out the light beam with the desired intensity profile.

2. The vehicle lighting system as claimed in claim 1, wherein the sensing unit is a camera.

3. The vehicle lighting system as claimed in claim 1, wherein the sensing unit is a thermal image camera capable of sensing ambient energy to generate the image signal.

4. The vehicle lighting system as claimed in claim 1, wherein, the operation unit is capable of outputting a recovery signal to the light processing unit when the intensity profile needs not to be changed in accordance with the judgment result.

5. The vehicle lighting system as claimed in claim 1, wherein the light processing unit is capable of receiving a control signal of the judgment unit and adjusting the intensity profile of the light beam according to the control signal.

6. The vehicle lighting system as claimed in claim 1, wherein the light processing unit is a light valve.

7. The vehicle lighting system as claimed in claim 6, wherein the light processing unit comprises a digital micro mirror device.

8. The vehicle lighting system as claimed in claim 1, wherein the non-uniform projection unit is a vehicle lamp cover comprised of at least one lens.

9. The vehicle lighting system as claimed in claim 1, wherein the non-uniform projection unit is a singlet lens or a lens module.

10. The vehicle lighting system as claimed in claim 1, wherein the light beam processed by the light processing unit has a Gaussian intensity profile, and the non-uniform projection unit is capable of converting the Gaussian intensity profile into a non-uniform intensity profile.

11. The vehicle lighting system as claimed in claim 1, further comprising:

a light source for emitting the light beam; and a beam expander disposed downstream from the light source in a light path.

12. The vehicle lighting system as claimed in claim 11, wherein the light processing unit is disposed downstream from the beam expander in the light path.

13. The vehicle lighting system as claimed in claim 11, wherein the non-uniform projection unit is disposed downstream from the light processing unit in the light path.

14. The vehicle lighting system as claimed in claim 11, wherein the beam expander comprises at least two lenses, and focus points of the two lenses are substantially the same.

15. The vehicle lighting system as claimed in claim 11, further comprising:

a beam homogenizer disposed between the light source and the light processing unit along the light path.

16. The vehicle lighting system as claimed in claim 15, wherein the beam homogenizer is a diffuser.

17. The vehicle lighting system as claimed in claim 11, further comprising a beam shaper disposed between the beam expander and the light processing unit along the light path.

18. The vehicle lighting system as claimed in claim 11, wherein the light source is capable of outputting a first light beam having first speckle size, the light processing unit receives a second light beam having a second speckle size, and the second speckle size is substantially larger than the first speckle size.

* * * * *